United States Patent [19]

Koehl

[11] 4,199,278

[45] Apr. 22, 1980

[54] INTERLOCKING MEMBERS FOR EXCAVATION LINERS

[76] Inventor: Jean-Marie G. R. Koehl, 3, rue Varengue, 92340 Bourg-la-Reine, France

[21] Appl. No.: 914,032

[22] Filed: Jun. 9, 1978

[30] Foreign Application Priority Data

Jun. 10, 1977 [FR] France ..... 77 17908

[51] Int. Cl.[2] ..... E02D 17/08

[52] U.S. Cl. ..... 405/282; 52/582; 52/828

[58] Field of Search ..... 405/282, 283; 52/562, 52/563, 564, 582, 585, 828

[56] References Cited

U.S. PATENT DOCUMENTS 841,773 1/1907 Fitzgerald ..... 405/282

FOREIGN PATENT DOCUMENTS 2057263 5/1972 Fed. Rep. of Germany ..... 405/282

2225029 10/1974 France ..... 405/282

*Primary Examiner*—Dennis L. Taylor

*Attorney, Agent, or Firm*—Hauke and Patalidis

[57] ABSTRACT

A support and connecting member permanently attached or, in the alternative, removably mounted on the internal surface of panels lining an excavation. The support and connecting members are in the form of a profiled liner beam or tie defining at least one slide channel allowing easy and quick positioning or removing of complementary profiled members providing a connection with cross-bars or struts, and which act as reinforcement and stiffening members which, when mounted in accordance with the work to be effected in the lined trench or excavation, reinforce the strength of the liners supporting the walls of the trench or excavation. The invention provides a modular-like system which, by the rational use of a few like components, permits to achieve by quick and simple means a trench lining adapted to either the requirement of the work to be effected in the trench or to the nature of the shored surrounding ground.

51 Claims, 31 Drawing Figures

1'
15
4
5
15
15
4
5
1
15
20

INTERLOCKING MEMBERS FOR EXCAVATION LINERS

BACKGROUND OF THE INVENTION

Workers, on construction sites, must constantly face problems during the excavation of trenches or the like, some of the problems being due to required variations in substantial degree in the depth and width of the excavation and others being due to the nature of the ground being excavated.

There may be, on the same site, some portions of excavations being effected in a ground having a perfect cohesion at some location, and a lesser or very weak cohesion at another location, such poor cohesion grounds having in some cases the consistency of liquid mud. It is therefore necessary, in order to meet all extreme conditions, to have available different types of lining materials or equipment ready at hand, which results in requiring a heavy capital investment and providing a poor return on the investment, because the materials and equipment are not always systematically and efficiently used; furthermore, the equipment must be constantly maintained and repaired.

A considerable variety of materials and equipment is available on the market, and they may be classified as follows:

(1) Pilings with tie beams welded at their center or at their ends;

(2) Pilings driven in the ground and between which are inserted panels provided with edges interlocking with the piling edges;

(3) Double pilings, either of unitary structure or slidable relative to each other, in engagement with the ground and between which panels are inserted;

(4) Panels on which are welded C-shaped or U-shaped channels adapted to accept the end of struts provided with rollers.

Such a list of diverse equipment, which is far from being complete, shows clearly the great number of different materials that a single construction firm must own or have available to it, because each type of equipment has a well-defined application.

The present invention remedies the inconveniences of the prior art in providing a type of equipment whose usage is so versatile as to solve a great number of problems without necessitating the use of special particular equipment according to the condition encountered in the course of the work.

SUMMARY

According to the present invention, the inner face of panel members used for lining and shoring the walls of an excavation or trench dug in the ground is provided with connecting means forming a single or a double slide aligned either along the vertical axis of the panel, or along its horizontal axis, or even at an angle to such axes, the members forming the connecting means being mounted fixedly or removably on the panel inner face such as to permit to position at any desired point of the liner inner surface, according to the location chosen for the connecting members, appropriate profiled members defining tie-beams or struts having a strength and rigidity adequate for transversely holding the liners against the walls of the trench, as required.

According to another aspect of the invention, the excavation lining system comprises at least one panel having an external and an internal surface, and at least one buttress member co-operating with tie-beams or struts, such surfaces and such buttress member comprising a removable fastening means for connection to the internal surface of the liner. The invention contemplates that the inner surface of the liner provided with the support member forms a linear slide in a forward direction parallel to the plane of the internal surface of the liner and that the buttress member presents at least one projecting portion of a form complementary to that of the slide channel with which the buttress member is interlocked such as to prevent motion in all directions other than the favored direction, and to be free longitudinally at least in a temporary manner along said favored direction and locked along said favored direction at least temporarily by means of a temporary locking arrangement.

The many advantages and objects of the present invention will become apparent from the following description, when considered in conjunction with the accompanying drawing showing examples of structure given for illustrative purpose only, and in which:

DETAILED DESCRIPTION OF THE PREFERRED EMBODIMENTS

Figure 1:
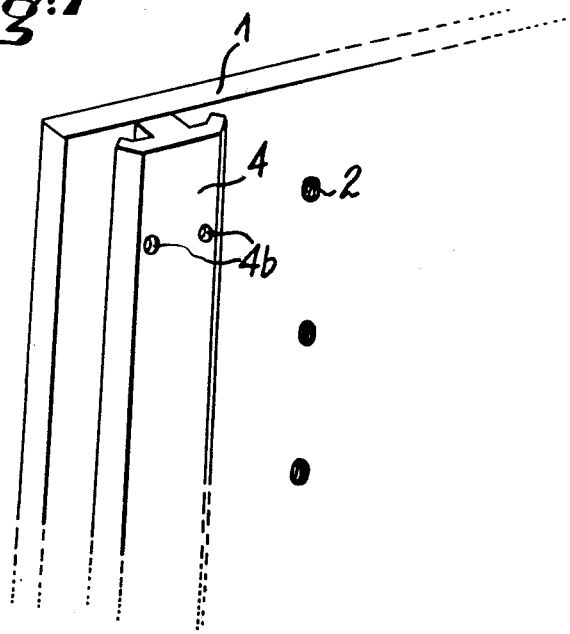
FIG. 1 is a perspective view of an excavation lining panel on which is mounted a support and connecting member according to the present invention.
Figure 2:
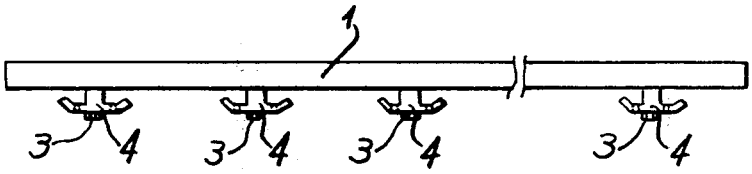
FIG. 2 is an end elevation view thereof showing the panel provided with a plurality of support and connecting members.

FIGS. 1 and 2 illustrate an example of an excavation or trench lining panel 1 provided on a face with one or more support and connecting members 4 according to an aspect of the present invention. In accordance with the invention, the inner surface of the panel 1 is provided with at least one connecting and support member 4 attached thereon preferably in a removable manner.

As illustrated at FIGS. 1, 2, 3 and 4, the support and connecting members 4 are disposed vertically, but it is readily apparent that the support and connecting members may be disposed horizontally. For example, a panel 1, of rectangular shape, forming a lining surface for a trench or excavation may be used with its greater length disposed horizontally to shore the walls of relatively shallow trenches, or with its longer length disposed vertically when shoring of walls of relatively deep trenches.

As shown at FIG. 1, the panel 1 forming the lining surface and which is made of any convenient material, for example of cast cement or concrete, metal, natural or synthetic plastic, etc. is provided with rows of threaded apertures 2 permitting the connecting members 4 to be mounted by means of bolts 3. The connecting members 4 are T-shaped in cross-section and form a pair of separate parallel slides, see FIGS. 2 and 3.

As shown at FIG. 2, it is thus possible to removably fasten the connecting members 4 at any appropriate location on the internal surface of the panel 1. If desired, the connecting members 4 may be permanently mounted on the internal surface of the panel 1 by any convenient means, such as riveting, welding, or the like.

Figure 3:
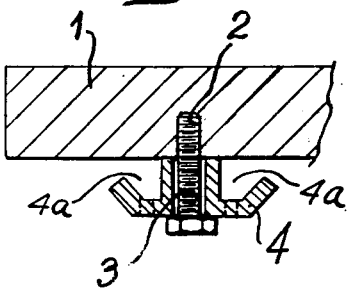
FIG. 3 is a partial view, at a larger scale and in section, of a panel showing the removable mounting of a connecting member.

FIG. 3 illustrates in detail a section through a panel 1 showing an example of structure for removably mounting a connecting member 4. According to the invention, the support and connecting member 4 has a shape which either by itself or in co-operation with the inner surface of the panel 1, provides at least one channel 4*a* in which is slidably disposed, by lateral pivoting, a stiffening buttress member 5, as illustrated at FIGS. 4 and 5.

Figure 4:
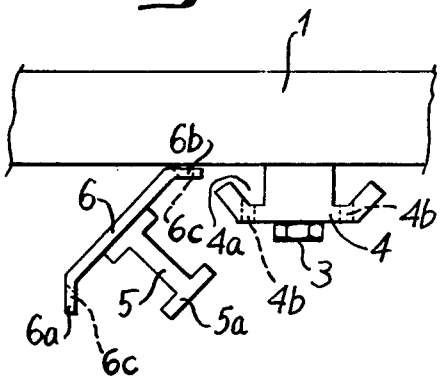
FIG. 4 is a partial end view of a panel provided with a connecting member into which a buttress member forming a stiffening element is in the process of being engaged.

FIG. 4 shows how the buttress member 5 is interlockingly introduced by lateral rotation into one of the slide channels 4*a* of the connecting member 4. The buttress member 5 is shaped such as to comprise at least one projecting portion 6, with or fastened to the buttress member 5, having a shape complementary to the shape of the connecting member 4 such as to form a sliding interlocked engagement therewith in the slide channel 4*a*, and which can accept a temporary locking means preventing longitudinal mutual sliding, as provided by the locking pin 7 shown at FIGS. 5*a* and 5*b*.

The buttress member 5 is I-shaped or T-shaped in section and, as best shown at FIG. 4, is preferably provided on one of its sides with the projecting portion 6 in the form of a longitudinal plate having angled flanged edges 6*a* and 6*b* conveniently engageable in the channel 4*a* disposed behind the ears of the connecting member. The face 5*a* of the buttress member 5 as engageable by the end of jacks, struts or similar members rigidly holding apart a pair of panels 1 disposed at an appropriate distance from each other for shoring opposite walls of a trench or other excavation. For temporary longitudinal locking of the buttress member 5 relative to the connecting and slide member 4 by means of removable pins 7, FIGS. 5*a* and 5*b*, appropriate holes 4*b* are provided in the connecting and slide member 4 for the accepting of the end of the pins 7, and corresponding slots 6*c* are provided at regular intervals in the flanges 6*a* and 6*b* of the buttress member 5.

Figure 5A:
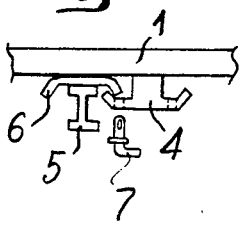
FIGS. 5*a* and 5*b* are views similar to FIG. 4 showing the buttress member fully engaged in the connecting member.
Figure 5B:
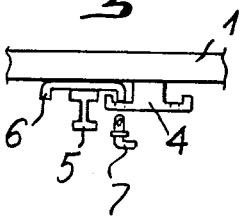
Figure 6A:
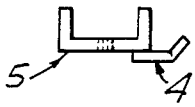
FIGS. 6*a* through 6*l* show schematically and in end views examples of connecting and buttress member profiles.
Figure 6B:
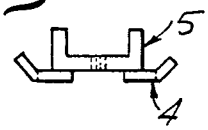
Figure 6C:
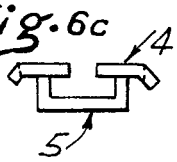
Figure 6D:
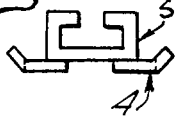
Figure 6E:
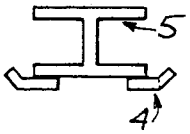
Figure 6F:
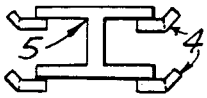
Figure 6G:
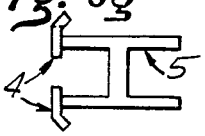
Figure 6H:
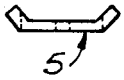
Figure 6I:
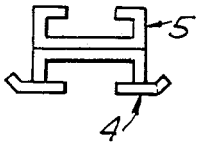
Figure 6J:
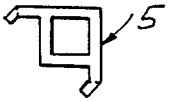
Figure 6K:
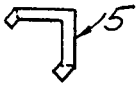
Figure 6L:
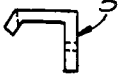

FIGS. 5*a* and 5*b* illustrate different shape of connecting members 4 for defining a slide and of buttress members 5 which may be used in co-operation with each other according to the invention. It is important however to note that the illustrated examples are not given for limiting purposes because the principal object of the invention is to provide a permanent interlocking of the buttress member 5 relative to the connecting member 5 in all directions along the plane of the surface of the plate 5 other than the direction permitting relative sliding displacement therebetween.

FIGS. 6*a* through 6*l* show, for illustrative purposes, different profiles for the buttress member 5 which, as exemplarily illustrated, can take any appropriate shape such as G-shape, U-shapes, H-shapes, or any other appropriate profile shape or combination of shapes, the diversely configurated buttress members being nevertheless capable of being slidably held by the corresponding connecting members 4.

Figure 7A:
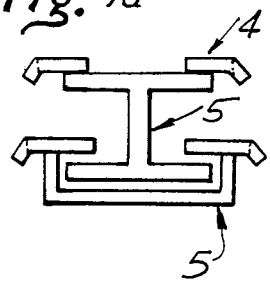
FIGS. 7*a* and 7*b* show further examples of combinations of connecting and buttress members.
Figure 7B:
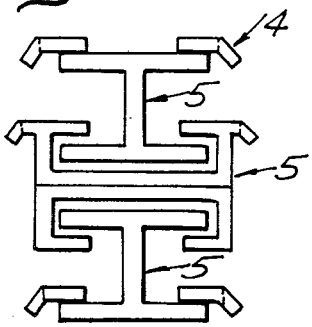

FIGS. 7*a*–7*b* show different possible combinations for buttress member 5 sliding at least temporarily one relative to the other.

A pair of panels 1 can be interconnected to each other in a parallel relationship, prior to placing into the ground, by means of tie members consisting of appropriate buttress members 5 and of struts or adjustable jacks rigidly holding the panels at an appropriate distance from each other. Diverse appropriate buttress members 5 are used according to requirements for facilitating the excavation work and the building of appropriate structures in the excavation, such as foundations, conduits, etc. having variable dimensions.

Figure 8:
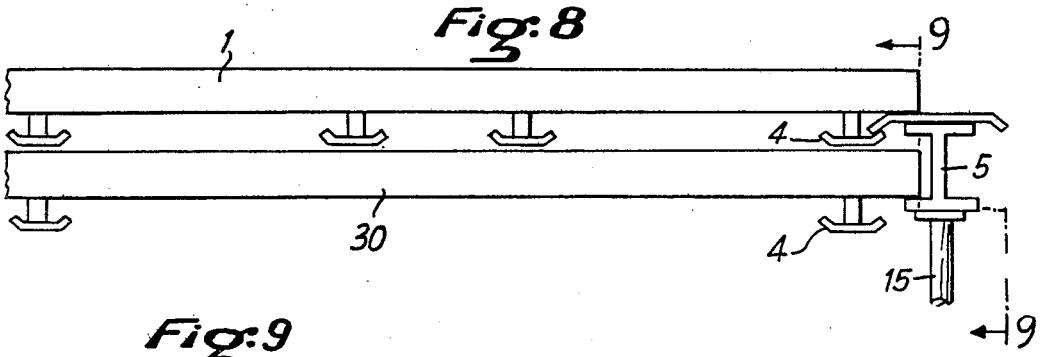
FIG. 8 is a top end view showing how a pair of panels are utilized for supporting the walls of deep trenches or excavations.
Figure 9:
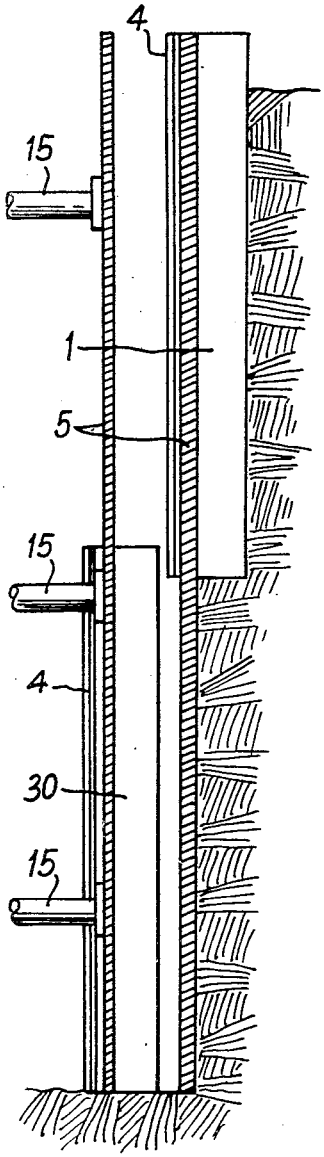
FIG. 9 is a section along line 9—9 of FIG. 8.

FIGS. 8 and 9 show the manner in which, when for example very deep trenches must be dug, an outside panel 1 is placed in position with its exterior surface engaged with the wall of the excavation, such outside panel 1 having at least one buttress member 5 connected to it by means of one of the connecting members 4, the buttress member attached to the panel 1 on its interior being connected to a panel, not shown, on the other side of the excavation by way of appropriate struts 15. A second panel 30, defining a further lining or shoring surface, which is identical to the panel 1 as shown, or which may be different, and which is provided with connecting members 5 on its interior surface, is sunk parallel to the panel 1 sliding along the buttress members 5. Although the panel 30 may be provided with its own buttress member or members, the buttress member 5 supporting the outer panel 1 is available for supporting the panel 30, the edge of which is engaged in the side channel of the buttress member. The struts 15 do not interfere in any way because they are disposed in the space separating a pair of panels 1 disposed adjacent to each other and thus additional linings prepared outside the trench can be sunk in the trench as desired.

Figure 10:
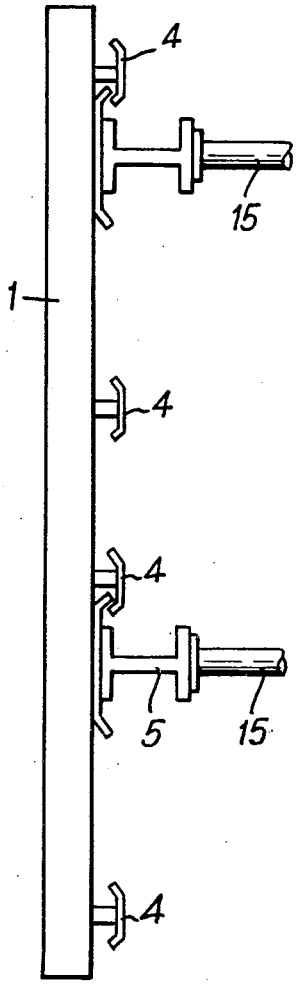
FIGS. 10 and 11 are side end views of vertically disposed panels provided with connecting and buttress members disposed horizontally.

FIG. 10 represents a panel 1 disposed vertically with the buttress members 5 disposed horizontally, which does not interfere with placing in position the struts 15.

Figure 11:
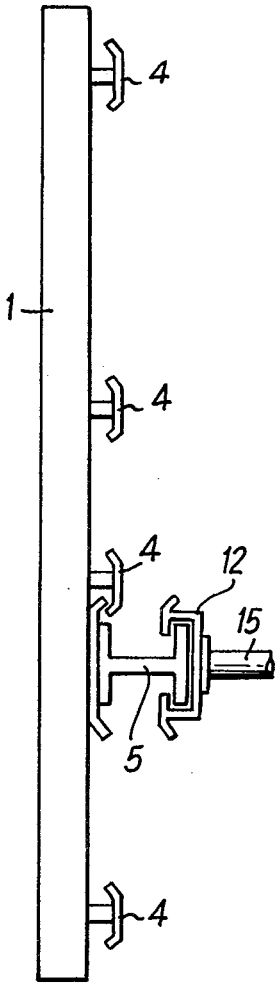

At FIG. 11 there is shown, relative to a panel 1 used in a vertical position, an arrangement for adjusting the lateral position of the struts 15 which is effected by sliding the C-shaped buttress member 12 along the buttress member 5.

Such an assembly is particularly advantageous for establishing cofferdams whose lengths are no longer a function of the standard width of the lining panels but of the length of the buttress members.

Figure 12:
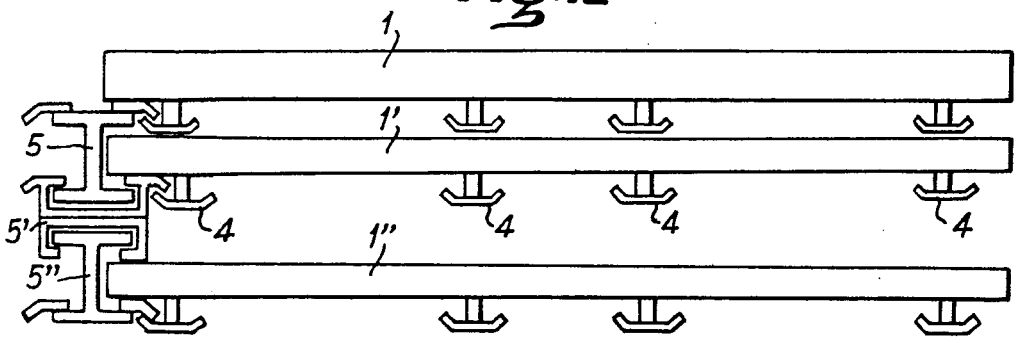
FIG. 12 illustrates a structure consisting of three parallel panels.

FIG. 12 illustrates a 3-stage lining utilizing a pair of buttress members 5 and 5'', each H-shaped in cross-section, and a buttress member 5' shaped in cross-section as a double C, all slidable one relative to the other. The lining panels 1, 1' and 1'' are thus sunk one after the other by sliding relative to the diverse buttress members acting as pillars.

Figure 13:
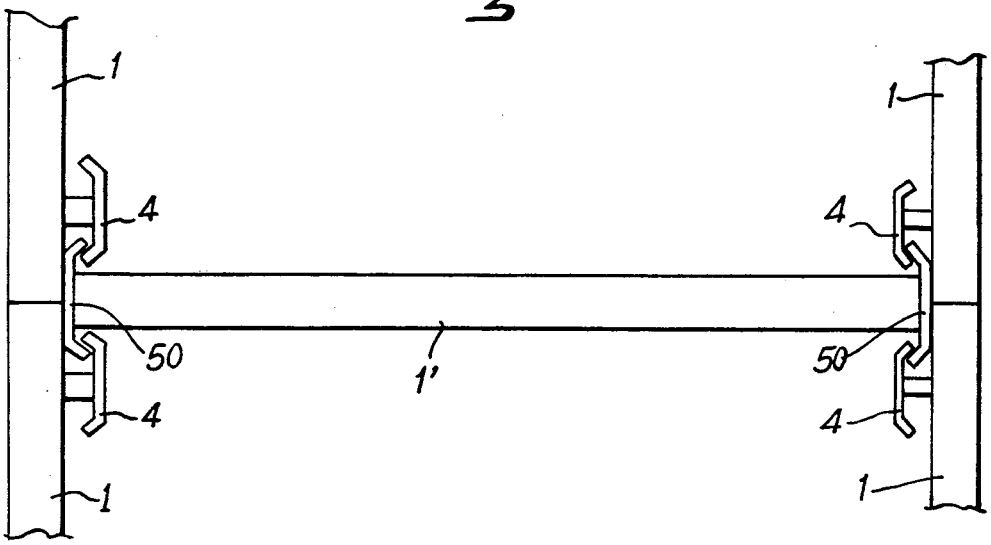
FIG. 13 schematically illustrates a panel cross mounted between a pair of parallel panel assemblies and acting as a strut between such assemblies.

FIG. 13 illustrates a panel 1' mounted as a cross-member or strut between two opposed longitudinally disposed pairs of panel members 1. Each of the panels 1 in a lateral pair is provided with a connecting slide member 4, and a generally U-shaped shoe 50 defining a buttress member and mounted on the opposite edges of the panel 1' interlockingly and slidably engages the corresponding sides of the connecting members of the adjacent panels 1 of each lateral pair.

Figure 14:
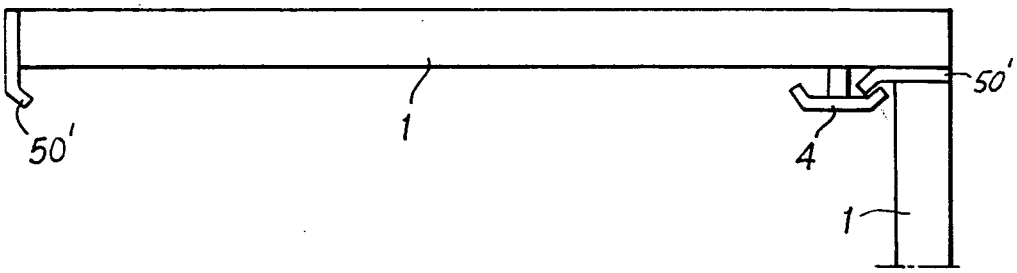
FIG. 14 is an end view of a panel assembly particularly adapted to the lining of wells.

FIG. 14 illustrates a panel 1 provided proximate an edge with a connecting slide member 4 and provided on one end with an interlocking shoe 50'. By using the panels 1 of FIG. 14, excavations of any shape, for example a well, can be effectively lined.

Using panels according to the present invention with connecting and buttress members disposed along a vertical axis is particularly advantageous when digging narrow trenches of great depth, as it permits, as work progresses inside the lined trench, to remove the struts and other support members which may interfere with the work.

At FIGS. 15 through 18, there are illustrated progressive steps during the lining of an excavation by means of disposable panels, according to the present invention, for example disposable panels made of pre-cast cement or concrete.

Figure 15:
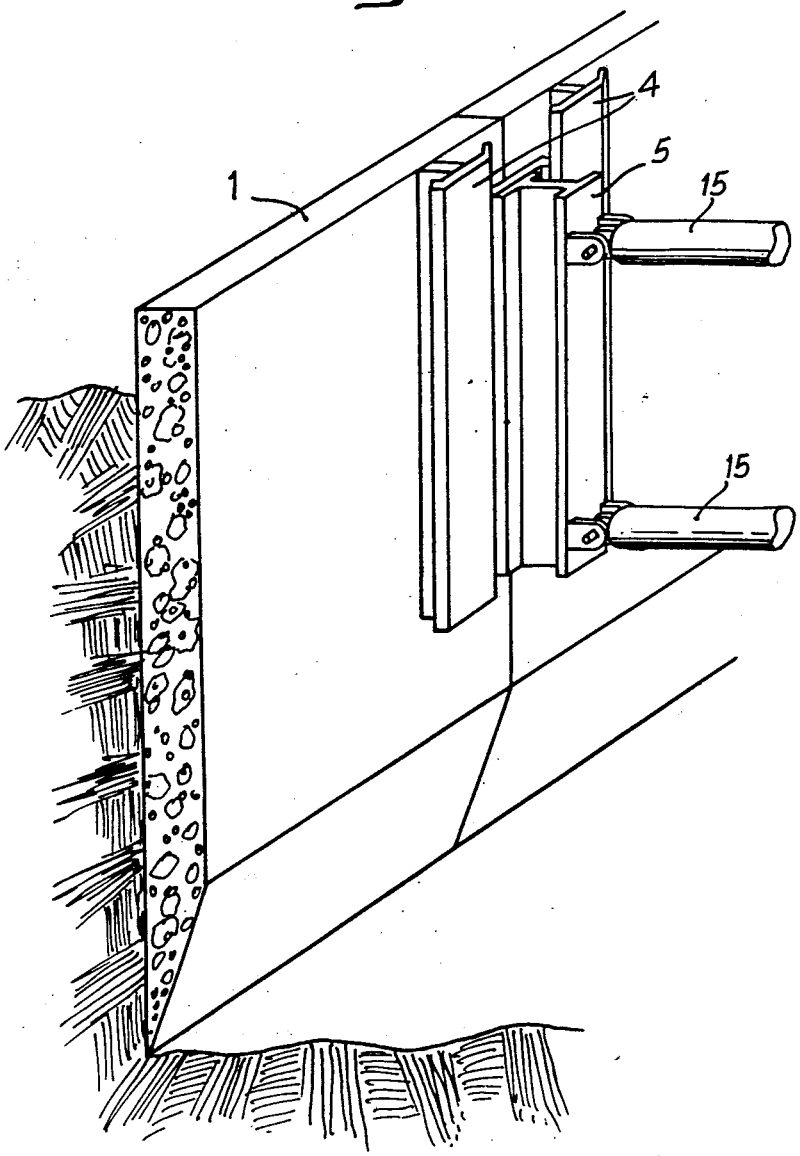
FIGS. 15–18 show progressive steps in the use of disposable panels, for example panels made of concrete.

At FIG. 15 is illustrated the step of sinking into the ground a pair of aligned disposable panels provided with struts 15 whose other end is similarly engaged with one or a pair of similar panels, not shown, disposed on the other side of the excavation. It is to be noted that, at FIG. 15, the tapered buttress member 5 is not aligned flush with the end of the connecting members 4.

Figure 16:
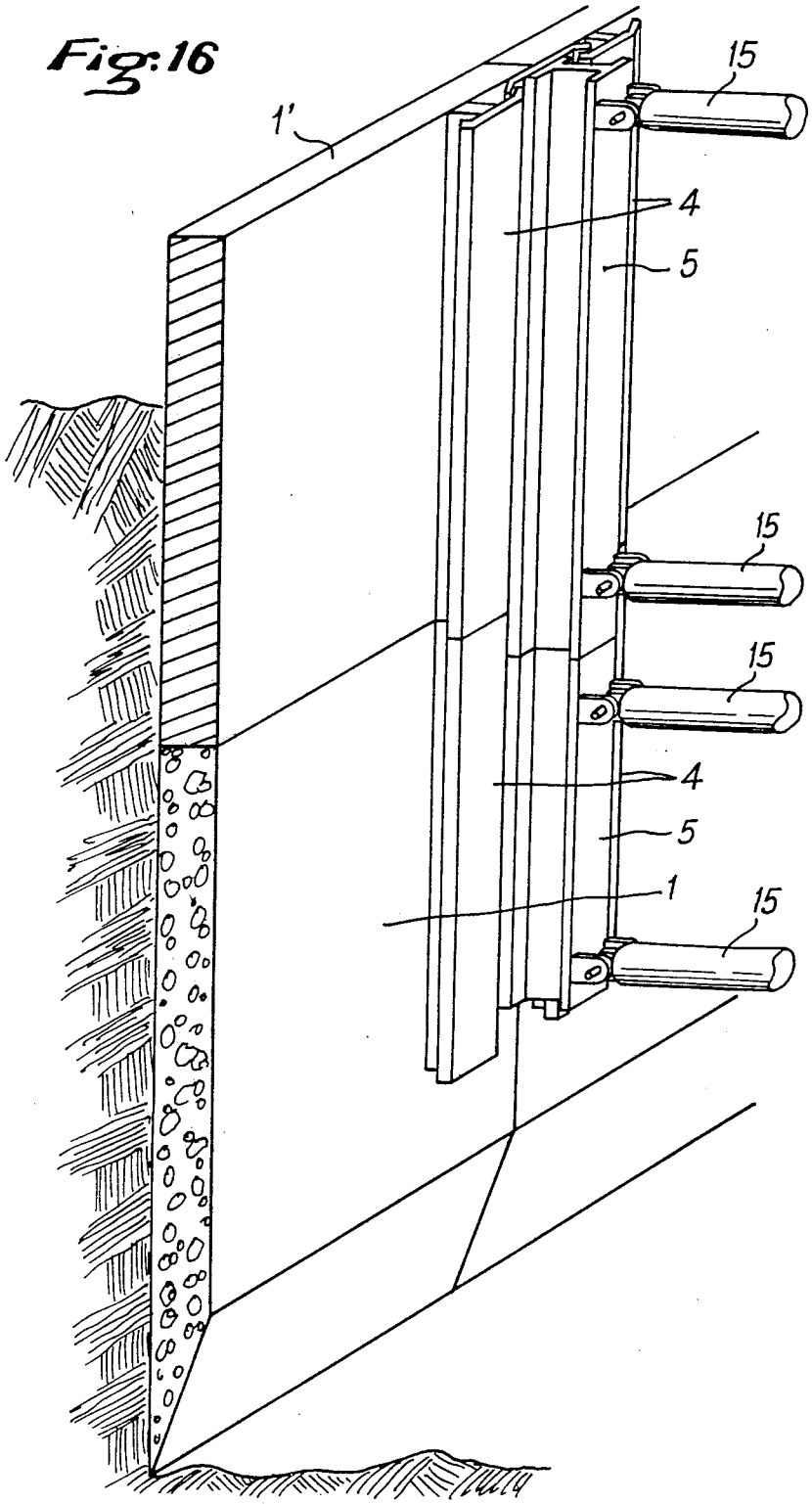

FIG. 16 shows the disposable panels 1 being driven into the ground by reusable panel 1' provided with their own connecting members 4 and a buttress member 5 engaged by the end of strut members 15.

Figure 17:
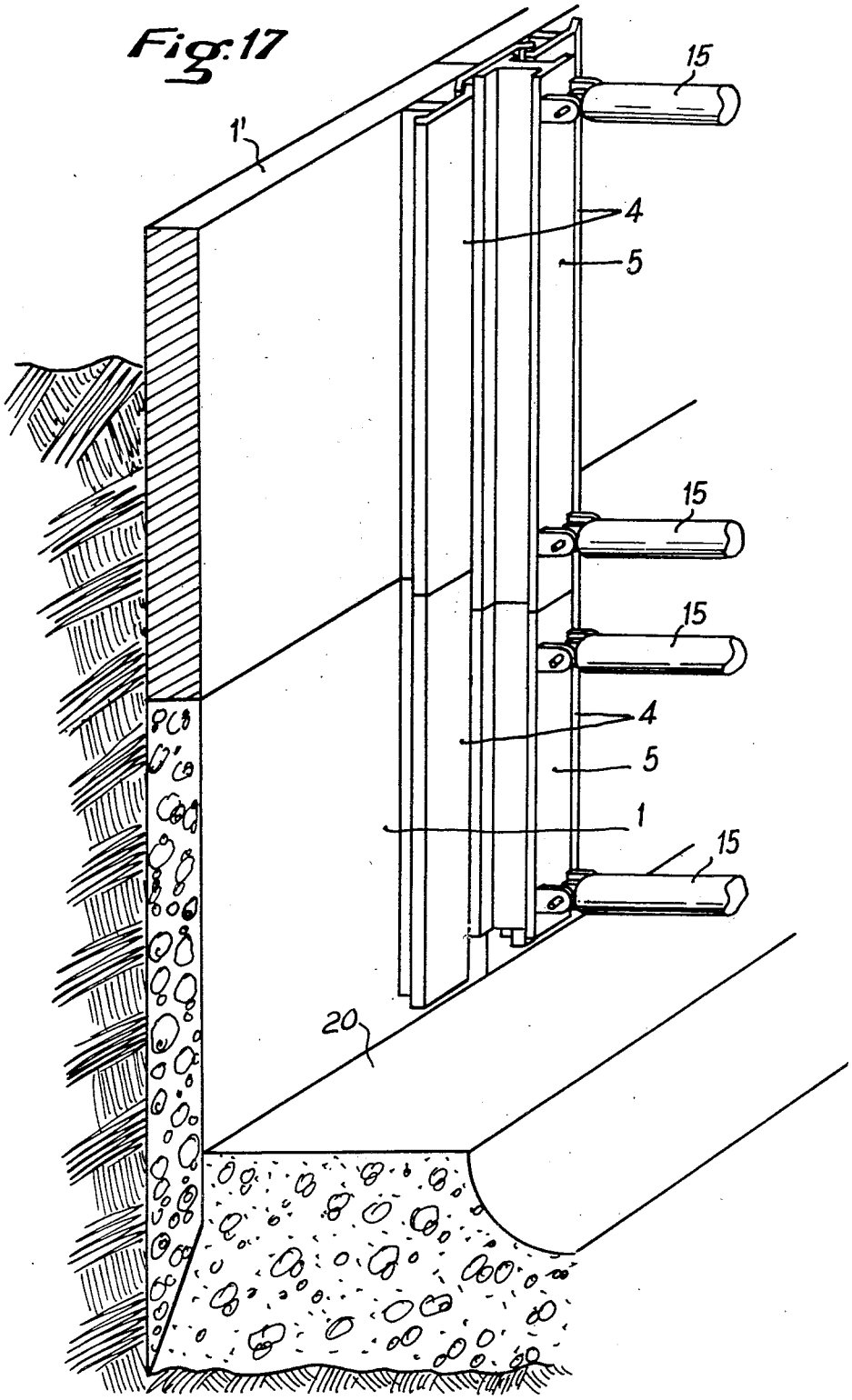

FIG. 17 illustrates the structures obtained after pouring a footing or conduit saddle 20 at the bottom of the trench.

Figure 18:
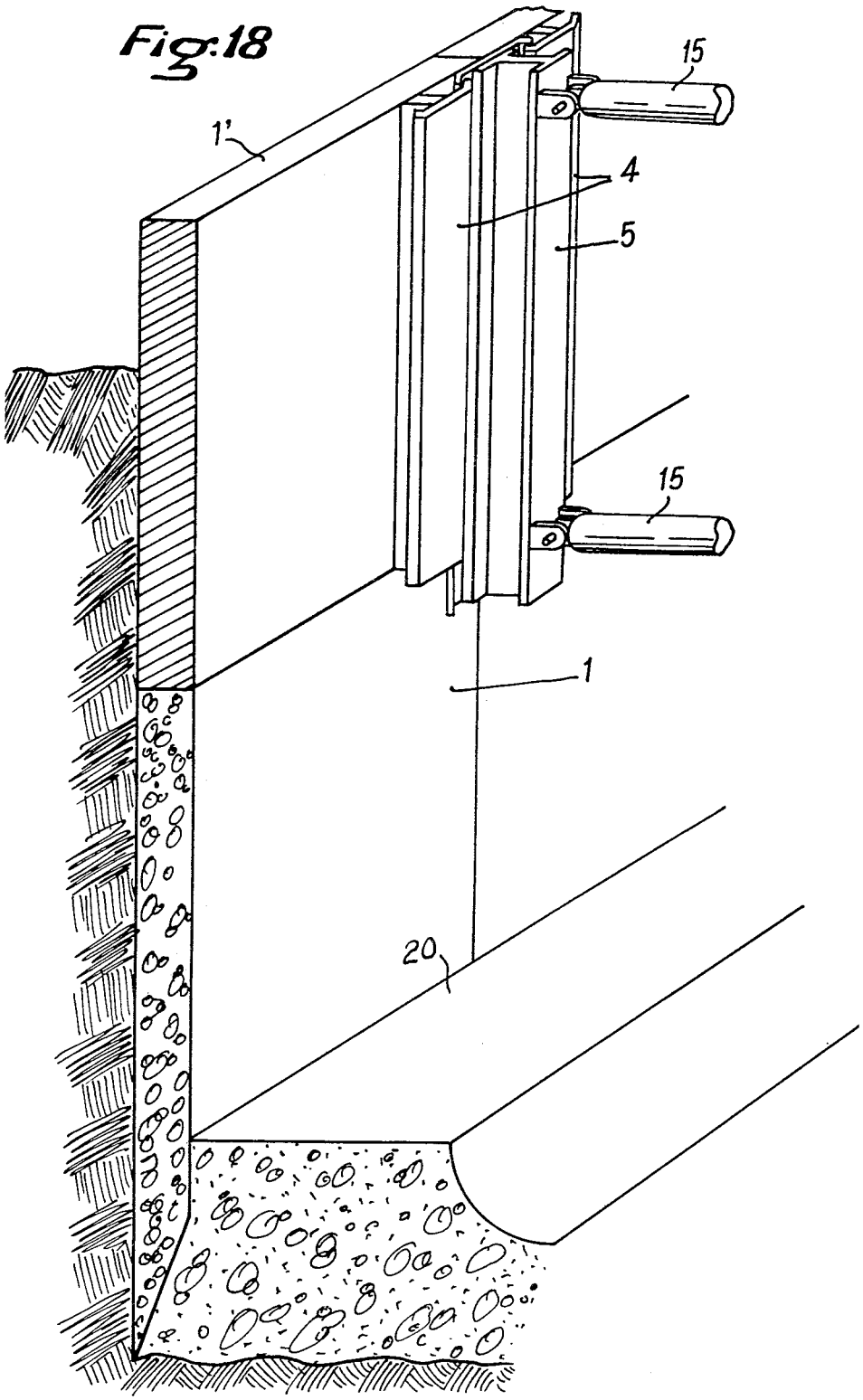

FIG. 18 illustrates a subsequent step wherein the connecting and buttress members and the struts holding the disposable liners 1 have been removed, the disposable liners 1 being held in position at their bottom by the footing or conduit saddle 20 and at their top by the overlapping buttress member 5 of the removable liner 1, and by the struts 15 attached to the buttress member 5.

Although some specific examples of the present invention have been hereinbefore described and illustrated in detail, it will be readily apparent to those skilled in the art that the invention is not limited to such examples given for illustrative purpose only and that diverse alternatives and modifications are included within the scope of the invention as hereinafter defined.

I claim:

1. Means for connecting the interior surface of an excavation wall liner with at least one support member, said means comprising a first elongated profiled member forming at least one slide mounted on said interior surface, said slide being oriented in a favored direction parallel to the plane of said interior surface, and a second elongated profiled member having a projecting edge engageable in said slide of said first profiled member for preventing displacement of said second profiled member in any direction other than said favored direction, wherein said first profiled member mounted on said interior surface has an end disposed proximate an edge of said liner, and said second profiled member has an end overlapping the edge of said liner.

2. The means of claim 1 further comprising means for at least temporarily blocking said second profiled member against displacement in said favored direction.

3. The means of claim 1 wherein said first profiled member has a length at most equal to the dimension of the liner on the interior surface of which it is mounted.

4. The means of claim 1 wherein said first profiled member is removably mounted on said liner interior surface.

5. The means of claim 1 wherein said first profiled member is permanently mounted on said liner interior surface.

6. The means of claim 1 further comprising a second liner disposed adjacent to the said first mentioned liner substantially co-planar therewith, each of said liners being provided with at least one of said first profiled members each aligned with the other, and one of said second profiled members engaged in said aligned first profiled members.

7. The means of claim 1 wherein said second profiled member has a shape complementary of that of said slide.

8. The means of claim 1 wherein said second profiled member is provided with means locking said second profiled member relative to said first profiled member at least temporarily.

9. The means of claim 1 wherein each second profiled member is provided with at least one mounting means for attachment to said support member, said support member having an axis substantially perpendicular to the plane of the interior surface of said liner.

10. The means of claim 1 wherein said second profiled member has a generally U-shaped cross-section conforming to the shape of said slide.

11. The means of claim 1 wherein said second profiled member has a generally H-shaped cross-section conforming to the shape of said slide relative to at least one of the wings of said H-shape.

12. The means of claim 1 wherein said second profiled member is C-shaped in section presenting at least a shape complementary of said slide.

13. The means of claim 1 wherein said second profiled member has a shape in section which is a combination of U-shape, H-shape, C-shape, and a further appropriate shape complementary to that of said slide FIG. 7*b*.

14. The means of claim 1 comprising at least a pair of said second profiled members, each of said second profiled members being slidable relative to the other.

15. The means of claim 1 wherein at least one disposable liner is driven into the ground by means of at least one reusable liner.

16. The means of claim 1 wherein the diverse elements are pre-assembled.

17. The means of claim 1 wherein said liner is reusable and said first and second profiled members are reusable.

18. The means of claim 1 wherein at least one of said support members is said liner.

19. Means for connecting the interior surface of an excavation wall liner with at least one support member, said means comprising a first elongated profiled member forming at least one slide mounted on said interior surface, said slide being oriented in a favored direction parallel to the plane of said interior surface, a second elongated profiled member having a projecting edge engageable in said slide of said first profiled member for preventing displacement of said second profiled member in any direction other than said favored direction, and a second liner disposed adjacent to the said first mentioned liner substantially co-planar therewith, each of said liners being provided with at least one of said first profiled members each aligned with the other, and one of said second profiled members engaged in said aligned first profiled members.

20. The means of claim 19 further comprising means for at least temporarily blocking said second profiled member against displacement in said favored direction.

21. The means of claim 19 wherein said first profiled member has a length at most equal to the dimension of the liner on the interior surface of which it is mounted.

22. The means of claim 19 wherein said first profiled member is removably mounted on said liner interior surface.

23. The means of claim 19 wherein said first profiled member is permanently mounted on said liner interior surface.

24. The means of claim 19 wherein said second profiled member has a shape complementary of that of said slide.

25. The means of claim 19 wherein said second profiled member is provided with means locking said second profiled member relative to said first profiled member at least temporarily.

26. The means of claim 19 wherein each second profiled member is provided with at least one mounting means for attachment to said support member, said support member having an axis substantially perpendicular to the plane of the interior surface of said liner.

27. The means of claim 19 wherein said second profiled member has a generally U-shaped cross-section conforming to the shape of said slide.

28. The means of claim 19 wherein said second profiled member has a generally H-shaped cross-section conforming to the shape of said slide relative to at least one of the wings of said H-shape.

29. The means of claim 19 wherein said second profiled member is C-shaped in section presenting at least a shape complementary of said slide.

30. The means of claim 19 wherein said second profiled member has a shape in section which is a combination of U-shape, H-shape, C-shape, and a further appropriate shape complementary to that of said slide (FIG. 7*b*).

31. The means of claim 19 comprising at least a pair of said second profiled members, each of said second profiled members being slidable relative to the other.

32. The means of claim 19 wherein at least one disposable liner is driven into the ground by means of at least one reusable liner.

33. The means of claim 19 wherein the diverse elements are pre-assembled.

34. The means of claim 19 wherein said liners are reusable and said first and second profiled members are reusable.

35. The means of claim 19 wherein at least one of said support members is one of said liners.

36. Means for connecting the interior surface of an excavation wall liner with at least one support member, said means comprising a first elongated profiled member forming at least one slide mounted on said interior surface, said slide being oriented in a favored direction parallel to the plane of said interior surface, and at least a pair of second elongated profiled members having a projecting edge engageable in said slide of said first profiled member for preventing displacement of said second profiled member in any direction other than said favored direction, each of said second profiled members being slidable relative to the other.

37. The means of claim 36 further comprising means for at least temporarily blocking said second profiled member against displacement in said favored direction.

38. The means of claim 36 wherein said first profiled member has a length at most equal to the dimension of the liner on the interior surface of which it is mounted.

39. The means of claim 36 wherein said first profiled member is removably mounted on said liner interior surface.

40. The means of claim 36 wherein said first profiled member is permanently mounted on said liner interior surface.

41. The means of claim 36 wherein said second profiled member has a shape complementary of that of said slide.

42. The means of claim 36 wherein said second profiled member is provided with means locking said second profiled member relative to said first profiled member at least temporarily.

43. The means of claim 36 wherein each second profiled member is provided with at least one mounting means for attachment to said support member, said support member having an axis substantially perpendicular to the plane of the interior surface of said liner.

44. The means of claim 36 wherein said second profiled member has a generally U-shaped cross-section conforming to the shape of said slide.

45. The means of claim 36 wherein said second profiled member has a generally H-shaped cross-section conforming to the shape of said slide relative to at least one of the wings of said H-shape.

46. The means of claim 36 wherein said second profiled member is C-shaped in section presenting at least a shape complementary of said slide.

47. The means of claim 36 wherein said second profiled member has a shape in section which is a combination of U-shape, H-shape, C-shape, and a further appropriate shape complementary to that of said slide (FIG. 7*b*).

48. The means of claim 36 wherein at least one disposable liner is driven into the ground by means of at least one reusable liner.

49. The means of claim 36 wherein the diverse elements are pre-assembled.

50. The means of claim 36 wherein said liner is reusable and said first and second profiled members are reusable.

51. The means of claim 36 wherein at least one of said support members is one of said liners.

* * * * *